United States Patent [19]

Eibe

[11] Patent Number: 4,793,172

[45] Date of Patent: Dec. 27, 1988

[54] THERMAL CROWN CONTROLLED ROLLS

[75] Inventor: Werner W. Eibe, Pittsburgh, Pa.

[73] Assignee: Italimpianti of America Incorporated, Coraopolis, Pa.

[21] Appl. No.: 108,110

[22] Filed: Oct. 13, 1987

Related U.S. Application Data

[63] Continuation-in-part of Ser. No. 832,379, Feb. 24, 1986, abandoned.

[51] Int. Cl.[4] ..... B21B 27/06

[52] U.S. Cl. ..... 72/200; 72/201

[58] Field of Search ..... 29/110; 72/13, 200, 72/201, 236, 202; 164/448; 165/89, 90

[56] References Cited

U.S. PATENT DOCUMENTS

| | | | |
|---|---|---|---|
| 2,068,779 | 1/1937 | Tunley et al. | 165/89 |
| 2,793,006 | 5/1957 | Eaby | 165/89 |
| 3,006,610 | 10/1961 | Siegel | 257/95 |
| 3,182,587 | 5/1965 | Woodhall | 72/200 X |
| 3,257,939 | 6/1966 | McDermott | 165/89 X |
| 3,367,042 | 2/1968 | Cox | 165/89 X |
| 3,604,237 | 9/1971 | Kawanami | 72/201 |
| 3,662,821 | 5/1972 | Saxon | 165/89 |
| 3,752,227 | 8/1973 | Bulson | 165/89 |

FOREIGN PATENT DOCUMENTS

| | | | |
|---|---|---|---|
| 913697 | 6/1954 | Fed. Rep. of Germany | 165/90 |
| 1003946 | 3/1957 | Fed. Rep. of Germany | 165/90 |
| 975326 | 11/1961 | Fed. Rep. of Germany | 165/90 |
| 119108 | 11/1984 | Japan . | |
| 2119968 | 11/1983 | United Kingdom . | |
| 605653 | 4/1978 | U.S.S.R. . | |

*Primary Examiner*—E. Michael Combs

*Attorney, Agent, or Firm*—Webb, Burden, Ziesenheim & Webb

[57] ABSTRACT

Rolling mill work and back-up rolls comprising an arbor with a sleeve shrunk thereon have circumferential grooves formed in the external surface of the arbor, through which heating or cooling liquid is supplied from external sources so as to expand or contract the sleeve and change the roll crown and contour. The fins, or material between grooves, may have higher heat conductivity than the material of the arbor and sleeve, and are proportioned to transmit rolling forces without reducing roll stiffness. A liquid supply system provides liquids of different temperatures to selected sections of the grooves along the roll working surface; and strip of different widths but of uniform gauge across the strip is rolled by suitably adjusting the temperatures of the hot and cold liquids so supplied.

12 Claims, 9 Drawing Sheets

THERMAL CROWN CONTROLLED ROLLS

This application is a continuation-in-part of my application Ser. No. 832,379, filed Feb. 24, 1986 for THERMAL CROWN CONTROLLED ROLLS, abandoned.

This invention relates to adjustable crown rolling mill rolls. It is more particularly concerned with rolls in which their crowns are adjusted by the addition or extraction of heat to or from the rolls.

BACKGROUND OF THE INVENTION

All industries that roll flat products such as paper, plastic, steel or other metal sheets must contour the roll surface in order to obtain an acceptable flatness or profile of the product. The most common approach has been the grinding of a crown onto the rolls which compensates for the composite roll deflections under load. This method, unfortunately, is effective only for a fixed loading and a unique product size.

It is well known that in the rolling of metals between rolls which themselves are hardened metal, usually steel, heat affects the crown of the rolls. In hot rolling most of the heat imparted to the rolls is derived from their contact with the hot metal but even in cold rolling the working of the metal generates heat, some of which is transferred to the rolls. As the roll heats its crown increases. The change in crown is measured in hundredths of a millimeter but in the rolling of strip of a few hundredths of a millimeter thickness changes in crown alter not only the gauge of the strip but its flatness or shape.

Radial heat flow in a steel roll is of course quite slow. A 1500 millimeter diameter back-up roll which has reached a steady state temperature of 120 degrees C. will require more than an hour for an 0.08 millimeter radial crown change and a 750 millimeter diameter work roll would require about half an hour for the same change. It is well known to spray a liquid coolant on a roll to control its crown but the thermal inertia of conventional rolls severely limits the usefulness of that expedient.

In addition to gauge and shape the strip producer is also concerned with the effect known as "edge drop", or feathering, which is another aspect of roll crowning. A strip mill operator is required to roll on the same mill strip of various widths as the customer orders. A perfectly flat strip from edge-to-edge could only be obtained, prior to my invention to be described hereinafter, when the strip is the same width as the mill. When narrower strip had to be rolled the pair roll ends extending beyond the strip on each side were forced together producing a tapered edge on the strip extending inwardly from perhaps 25 millimeters to as much as 100 millimeters in some cases. That edge had to be trimmed off in a later operation so reducing the yield from the mill. One method of dealing with that problem is suggested in Feldmann, et al. U.S. Pat. No. 4,479,374 of Oct. 30, 1984. A roll stand is there disclosed which has lathe-type tools adjusted to trim down the ends of the work roll projecting beyond the strip. With such a mill rolling must be scheduled so that all wide strip orders are rolled before narrow strip orders are rolled.

SUMMARY OF THE INVENTION

In my invention I control the crown and general contour of rolling mill work or back-up rolls by varying their temperature in critical regions. The temperature is varied by introducing pre-heated or pre-cooled heat exchange liquid at selected roll areas. The rolls are structured to expedite heat transfer to and from their work surface without weakening the roll or reducing its stiffness, and fast enough for on-line strip profile and flatness control. My preferred roll embodiment is a composite roll comprising a steel arbor and a metal sleeve shrunk thereon, the arbor being formed with circumferential grooves between circumferential fins, the fins having a radial dimension considerably greater than their axial dimension. Those grooves are connected within the arbor and with an external source of hot or cold fluid by bores extending through the roll ends. The fin dimensions are selected to bring about a primary transfer of heat from the external fluid to the fins which is greater than the transfer of heat from the external fins to arbor or from the bottom of the fins to the arbor.

DESCRIPTION OF PREFERRED EMBODIMENTS

Figure 1:
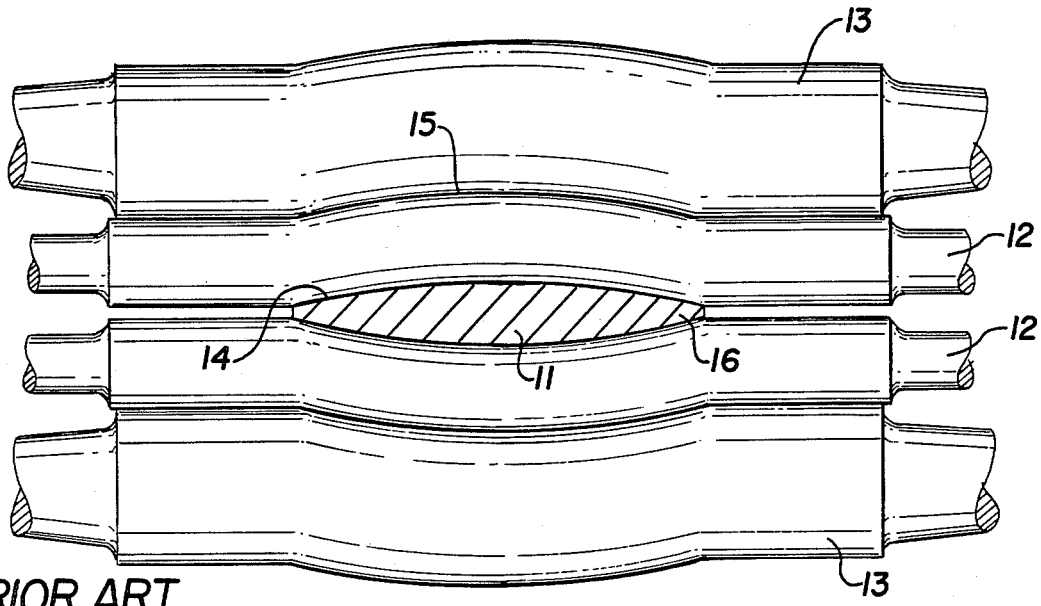
FIG. 1 PRIOR ART
FIG. 1 illustrates the prior art rolling of a crowned workpiece in a strip mill with flat rolls.
Figure 2:
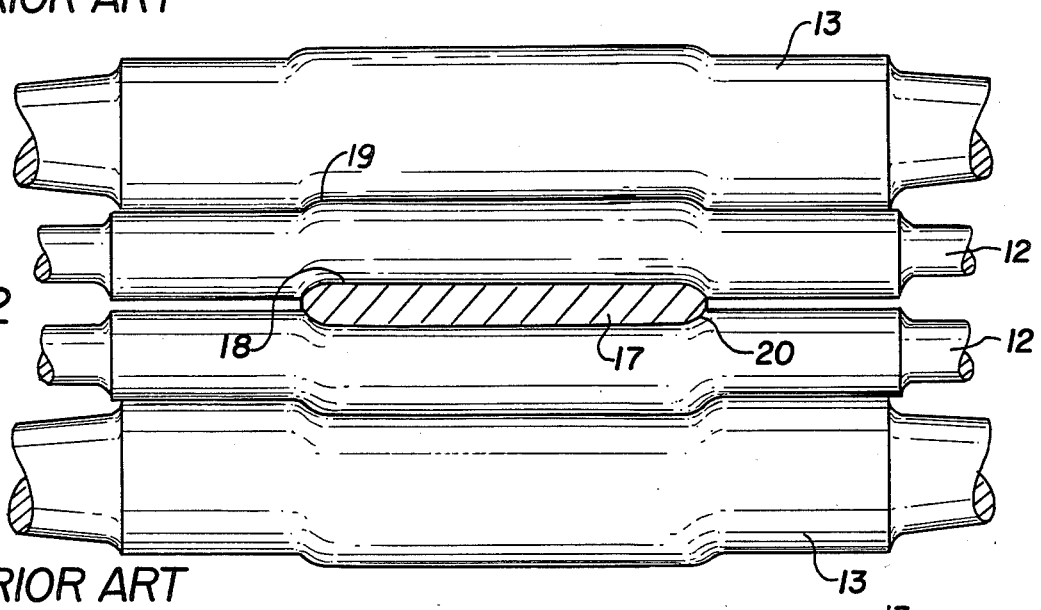
FIG. 2 PRIOR ART
FIG. 2 illustrates the prior art rolling of a flat workpiece in a strip mill with flat rolls.
Figure 3:
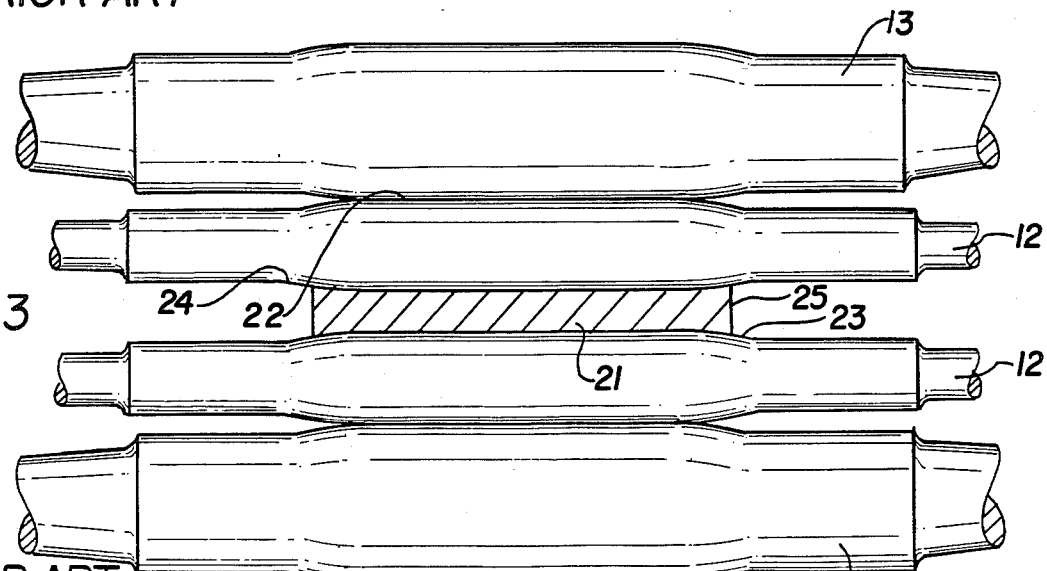
FIG. 3, illustrates the prior art rolling of a flat workpiece in a strip mill with crowned rolls.

Three conditions of strip mill operation known in the prior art are shown in exaggerated form in FIGS. 1, 2 and 3. One or another of those conditions occurs when metal strip is roll on a mill wider than the strip itself. In FIG. 1 a workpiece having a positive crown from prior processing is passed between flat work rolls 12, usually supported by backup rolls 13. The workpiece deforms work rolls 12 in their center portion and the deformed work rolls 12 correspondingly deform back-up rolls 13 in their center portion 15. That roll deformation is greatest at the mid-point between roll ends, as is shown, and decreases toward each end of the roll. The edges 16 of the resulting strip are squeezed down to a thickness less than the desired gauge, the "edge drop" before noted, and those edges must be trimmed as was also before mentioned.

In FIG. 2 workpiece 17 entering work rolls 12 is flat. It deforms flat work rolls 12 in their center portion 18 and the deformed work rolls deform back-up rolls 13 in their center portions 19 but those deformations are relatively flat over most of their extent. The edges 20 of the resulting strip are however, as before, squeezed down to a thickness less than the desired gauge and must also be trimmed.

FIG. 3 shows an effect on an initially flat workpiece 21, of deliberately crowning work rolls 12 and back-up roll 13, the crown being more or less coextensive with the workpiece width. Under load the deformed regions 22 of work rolls and back-up rolls are relatively flat in profile over most of the workpiece 21 but in regions 23 and 24 where the crown merges into the roll ends there is an edge rise, or negative edge drop 25. By careful contouring of the work rolls and the back-up the strip edges may be maintained at the gauge of the strip center but only for a unique width of strip.

Figure 4:
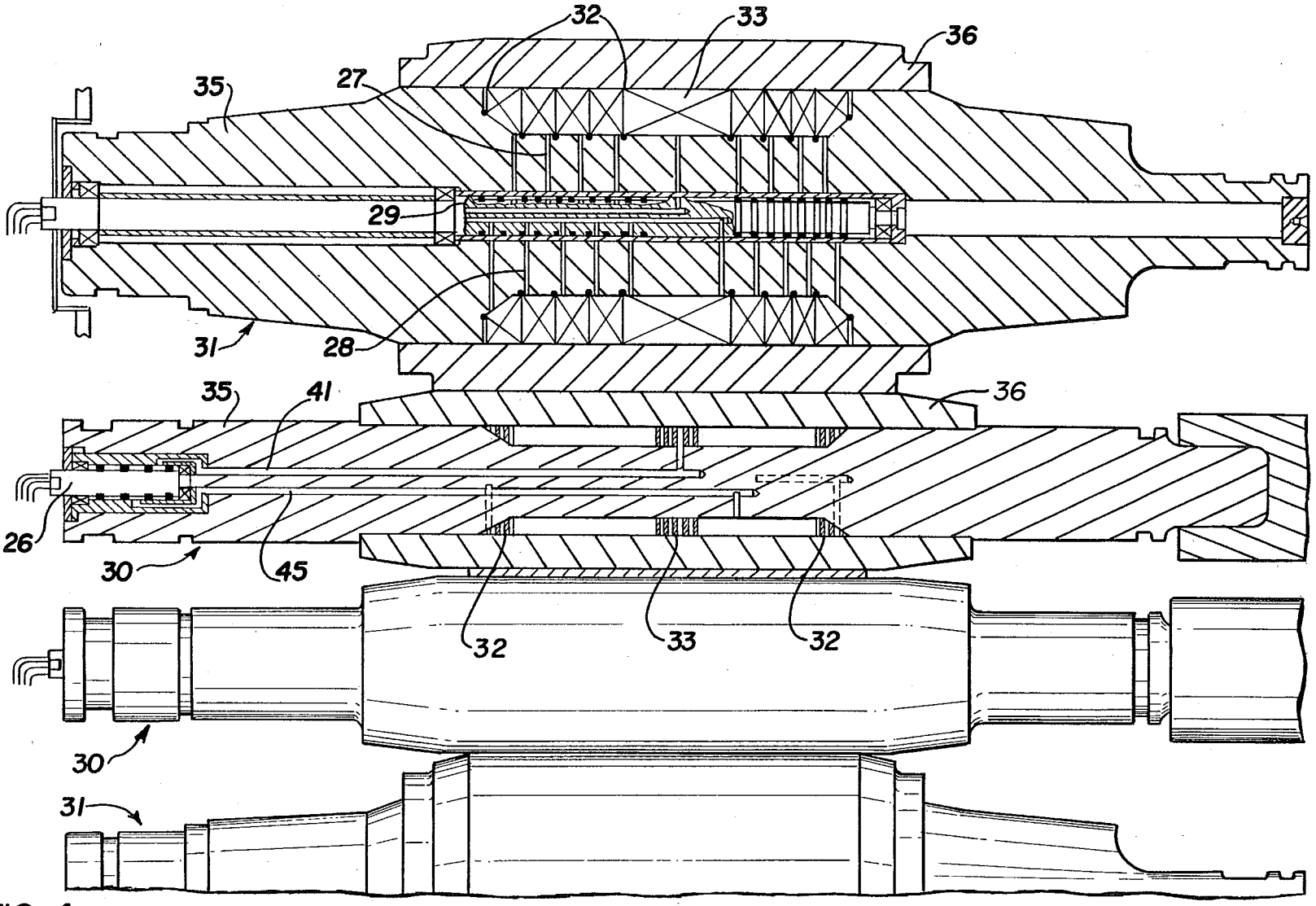
FIG. 4 is a sectional view of a four-high mill with rolls of my invention.

My invention is diagrammatically represented in FIG. 4 which illustrates a roll stack of work rolls 30 and back-up rolls 31, only one of which back-up rolls is shown in full. The rolls of both types preferably comprise an arbor 35 with a sleeve 36 shrunk on it, as will be described in detail hereinafter.

Work rolls 30 have arbors 35 comprising a plurality of circumferential heat exchange element groups 32 set therein of which only two are shown, preferably evenly disposed on each side of a central element group 33. The individual heat exchange unit groups 32 and heat exchange unit 33 are each supplied with heating and cooling fluid generated externally of the rolls through bores such as 41 and 45 extending to the ends of the roll and cross-bores to be described hereinafter. At the roll end the bores are connected to an external supply of heat exchange liquid through a rotating joint 26. Back-up rolls 31 are similarly constructed. Where a number of individual heat exchange units 32 are placed together side-by-side it is sometimes desirable to having individual entry and exit cross-bores 27 and 28 for each unit 32, which cross-bores connect to a rotating joint 29 in the interior of the arbor. The non-rotating element of that joint and feed and drain lines thereto, not shown, then extend through the end of the arbor, thus simplifying the heat exchange liquid supply system in the roll. By varying the heating or cooling medium supplied to the respective heat exchange elements the crown or contour of the roll shell 36 can be adjusted for strip of any width. For example if relatively narrow strip is to be rolled the three outside heat exchange units 32 at each end of the roll would be unheated or perhaps cooled; the two units 32 of each side of the central unit 33 could be warmed and the central unit 33 could be heated to obtain maximum crown in that region.

It is essential to my invention that heat transfer to and away from the roll sleeve be rapid. One embodient of roll satisfactory in that respect is shown in section in FIG. 5. The roll comprises an arbor 35 and a cylindrical sleeve 36 shrunk thereon. Sleeve 36 is conventional. Arbor 35 is formed with a pair of spiral circumferential grooves 37 and 38 of opposite hand joining in groove 39 at the center of the roll. That groove is connected by cross-bore 40 to longitudinal bore 41 which extends through one end of the arbor to external supply means, not shown, for a heat exchange medium. The outside end of groove 37 is connected by a cross-bore 43 to a longitudinal bore 45 which extends through arbor 35 and the outside end of groove 38 is likewise connected to bore 45 through cross-bore 44.

The arrangement above-described provides for two control sections 37 and 38. To increase the roll crown a heating medium is supplied to both sections through bores 40 and 41 and drawn off through bores 43, 44 and 45. To decrease crown a cooling medium would be substituted for the heating medium or the heating medium could be supplied through bores 43, 44 and 45 and drawn off through bores 40 and 41. The arrangement is greatly improved by connecting the center groove 47 of section 37 by a cross-bore 49 to a longitudinal bore 51 and the center groove 48 of section 38 by a cross bore 50 to longitudinal bore 51, thus providing four control sections. The central sections of course need not be of the same size and it may not always be desirable to operate them so as to obtain a symmetrical crown.

Figure 5:
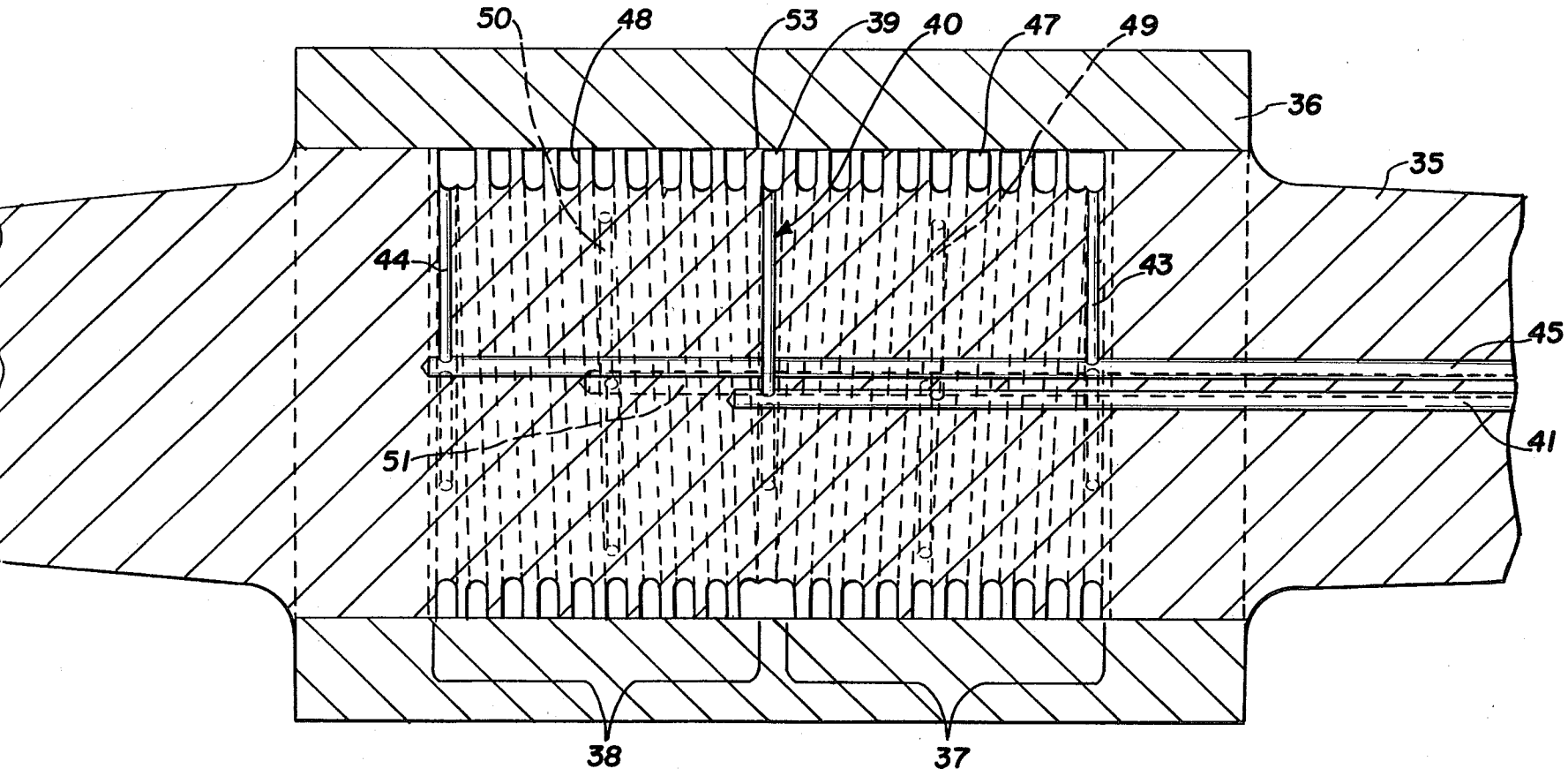
FIG. 5 is a detail of a roll of my invention.
Figure 6:
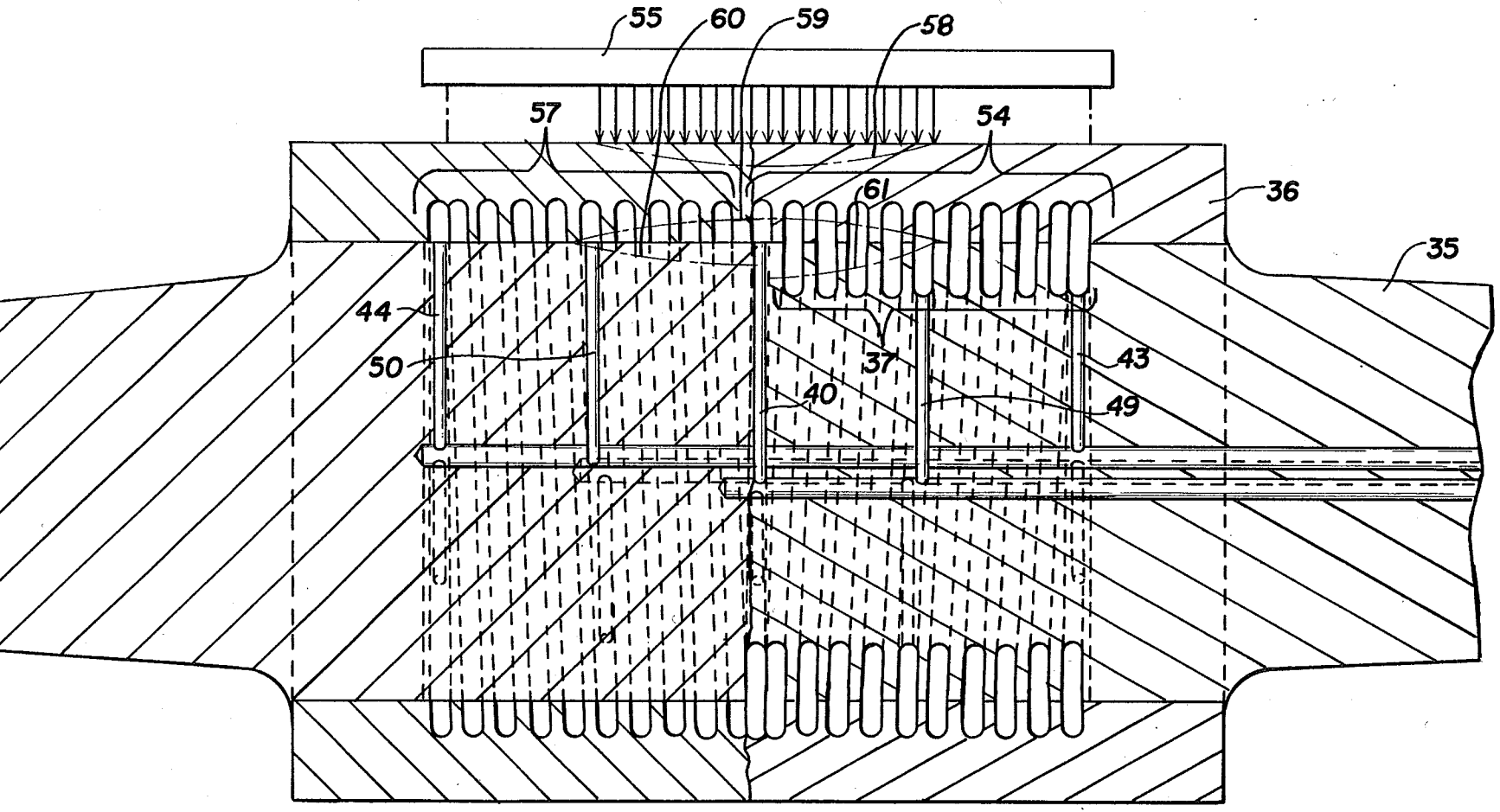
FIG. 6A is a schematic section of a roll of my invention showing the directions of the three components of heat flow therein.
FIG. 6B is a schematic section of a prior art roll showing the directions of the two components of heat flow therein.
Figure 6A:
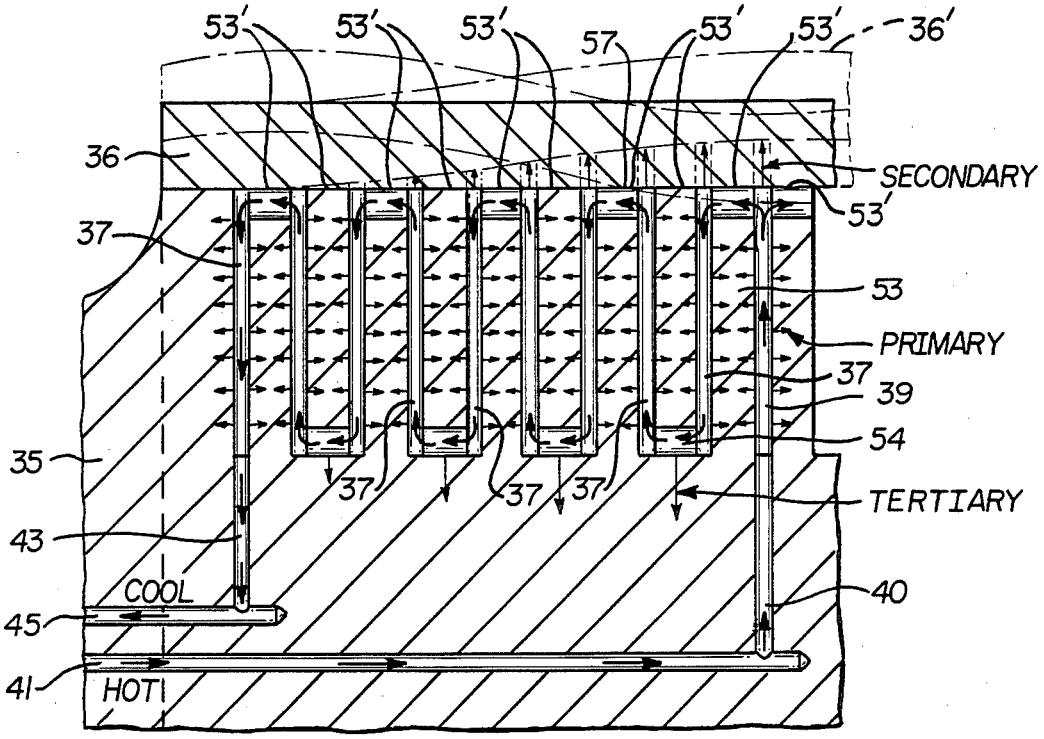

The circumferential roll section forming fins 53 between grooves 47 and 48 shown in FIG. 5 must be strong enough to withstand rolling pressure but should not be any thicker than necessary so that heat transfer from the medium in the grooves to the sleeve should be rapid. In FIG. 6A hot heat transfer medium is shown as being introduced through axial bore 41 and cross bore 40 into center groove 39 of FIG. 5 so as to transfer heat to fins 53 adjoining groove 39. The fins and groove can be spiral, as shown in FIG. 5, or indepently circumferential, as shown in FIG. 6A. Independent circumferential grooves must of course be connected together if they are not separately connect to the input and output conduits or by axial or cross bores, and can conveniently be so connected by holes 54 or channels 57 in alternate fins. In FIG. 6A each fin 53 in arbor 35 of a roll of my invention has a radial dimension about five times its axial dimension. The primary or principal transfer of heat from the hot fluid in conduit 41 is through the fins 53 as shown on FIG. 6A by small arrows. There is a large area of contact betwen hot fluid and fins on both sides of grooves 37. From the heating fluid there is a secondary transfer of heat directly to sleeve 36 also shown by arrows at the outside edges of grooves 37 which are relatively narrow. Finally, there is a tertiary transfer of heat from the fluid to arbor 35 at the bottom of grooves 37.

Figure 6B:
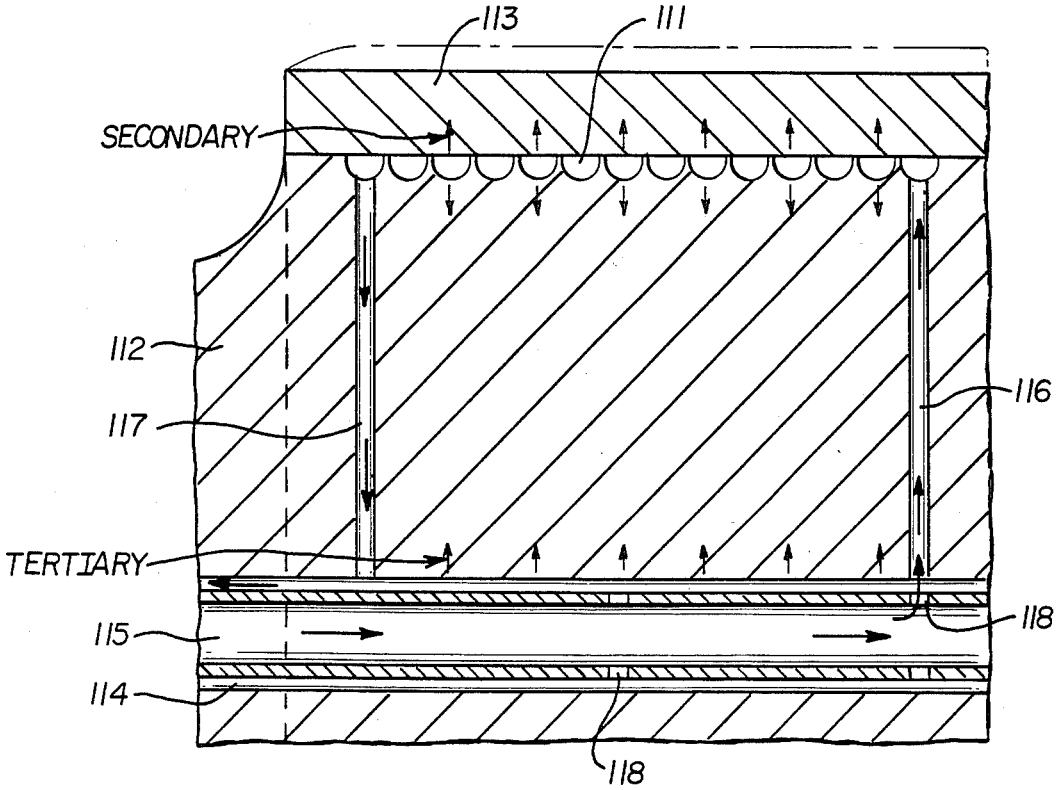
FIG. 6B PRIOR ART

The primary transfer of heat shown in FIG. 6A is much greater than the secondary and tertiary transfers and it is also greater nearer the cross bore 40 than it is remote from that bore. FIG. 6B illustrates the two components of heat transfer in prior art thermal crown controlled rolls such as are used in calendars and other apparatus where the material rolled must be heated. The arbor 112 is formed with a spiral groove 111 on its circumference and sleeve 113 is fitted over it. The arbor 112 is bored on its centerline to form an axial duct 114 and inside it is placed a coaxial smaller diameter duct 115 which has openings 118 into duct 114 at intervals along its length. Duct 114 is connected by riser 116 with one end of spiral groove 111 and by riser 117 with the other end of that groove. A component of heat transfer from groove 111 to sleeve 113 shown by arrows is marked "secondary" because it corresponds to some extent with the secondary component of FIG. 6A. Another component of heat transfer from duct 114 to arbor 112 marked "tertiary" corresponds to the tertiary component of FIG. 6A. There is no significant component of FIG. 6B corresponding to the heat transfer marked "primary" in FIG. 6A.

The diameter of the fins will of course depend on the size of the roll, its function, and the nature of the control desired. For continous rolling mills it is important to have gauge (thickness along the strip) and profile (thickness across the strip) corrected within seconds or fractions thereof. Hydraulic cylinders effect quick correction of gauge. Various methods are used for profile correction, the fastest being hydraulic roll bending and the slowest, prior to my invention described herein, by supplying heat to or withdrawing it from the roll body. The time required for heat transfer through a body increases approximately with the square of the distance it must travel and for conventional rolling mill rolls would take much too long for on-line crown changes. I have found that in steel rolling mill rolls as hereindescribed the ratio of fin length, the radial distance from the root of the fin to its surface, to its width, measured axially, is desirably in the range from about 4 to about 10 for on-line crown correction.

For continuous rolling mill applications, it is of utmost importance to have gauge and profile changes corrected within seconds or fractions thereof. Hydraulic cylinders make quick corrections for gauge changes. For strip profile correction various methods are used the fastest being hydraulic roll bending and the slowest by inserting or extracting heat in and out of the roll body. The most customary heat exchange is by spraying the roll body externally and, internally, but it is too slow for on-line use.

In the roll of my invention, as shown in FIG. 6A, a sleeve 36 is shrunk upon the upright fins 53 cut into the roll arbor 35. The slenderness ratio L/T of those fins is kept as large as possible without affecting the mechanical stiffness of the roll to a larger extent. Minimum value of L/T is about 4 and maximum is about 10, in backup rolls. Buckling of these fins under the heavy shrinking and rolling forces is prevented by tying them together with rods or the like as in FIGS. 8 and 9.

For achieving a convex crown, hot fluid is channeled to the center of the mill roll expanding the center fins at ends 53' a certain $\Delta$ L. While going up and down through holes in the fins 53, the fluid temperature will drop a pre-calculated amount, expanding each of the following fins a smaller amount with the last one having only a small $\delta$ L. By varying the fluid volume and temperature, the amount of roll crown can be pre-established and changed quickly by measuring the results on the strip in closed loop operation.

For a concave roll crown, the flow is reversed.

The total expansion of the roll is comprised of three sub-expansions

1. The primary fin expansion which is argest because of the ratio of fin length to fin wall thickness. This lateral heat exchange is the principal control feature, pushing out the sleeve with temperature increase and letting the sleeve collapse, due to the shrink and rolling forces, with temperature decrease.

2. Secondary (through radial heat exchange between heating fluid and sleeve) expansion of the sleeve. There is no need to wait for this much slower and smaller action on the roll crown.

3. Tertiary expansion through radial heat exchange between heating fluid and arbor is still slower and can be practically ignored.

The amount of thermal expansion ($\Delta$L) of the fins 53 in the radial direction, i.e., toward the roll sleeve 36 according to known thermal expansion formulas, is directly proportional to the length of the fins, the increase in temperataure ($\Delta$T) of the fins and coefficient of thermal expansion of the fin material. The fin geometry of my invention maximizes the length as well as the surface ara in contact with the heat transfer medium. These features then maximize the length and $\Delta$T factors in the known thermal expansion equation. As the fins 53 are rapidly heated by the hot fluid flowing throuogh the grooves 37, the fins rapidly expand radially outwardly whereby the ends 53' of the fins push the roll sleeve 35 outwardly to a position shown in phantom lines 36' in FIG. 6A. A new roll crown profile is thus, established. In a reverse mode or cooling mode, the opposite action occurs and the roll sleeve 36 rapidly contracts following the radially contracting cooled fins due to the shrink fit between the sleeve and arbor and also due to the rolling forces applied.

My internal roll structure provides:

(a) the largest surface for efficient heat exchange while maintaining mechanical strength, (b) the quickest maximum shape changes per time unit, (c) the best fluid pumping efficiency created by extended fluid travel through the fins, permitting a maximum temperature gradient, (d) still faster reaction can be obtained by making fins of high conductive material, such as bronze or aluminum alloys as will appear.

Figure 7:
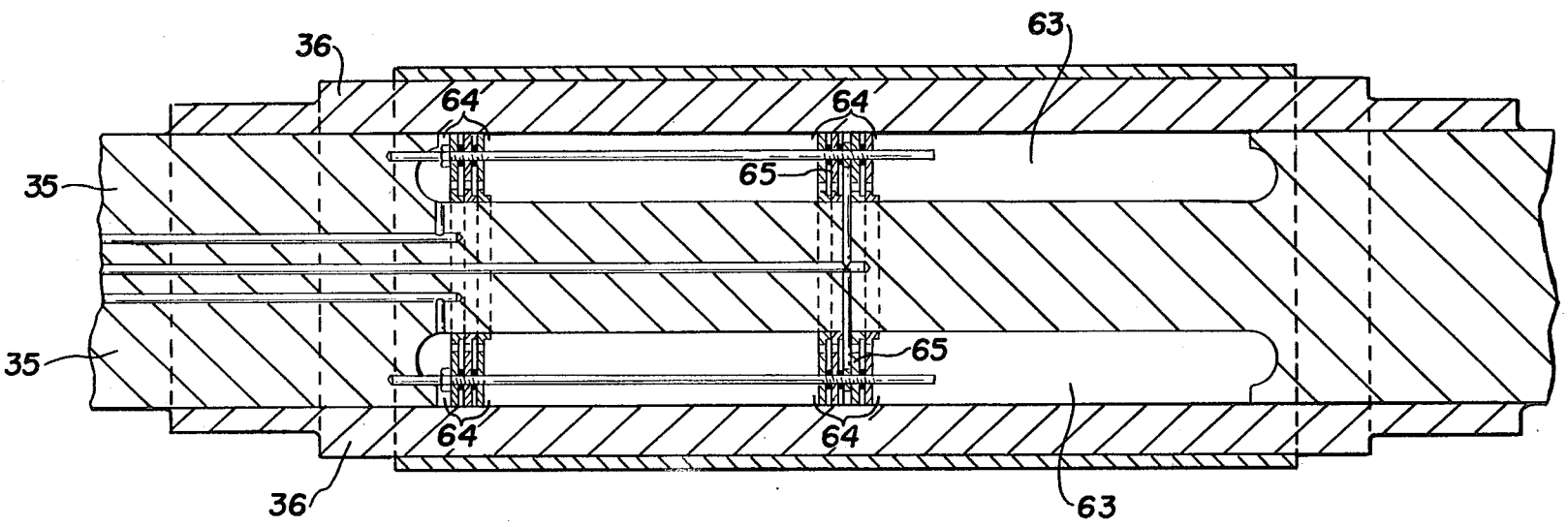
FIG. 7 is a detail of a second embodiment of a roll of my invention.
Figure 9:
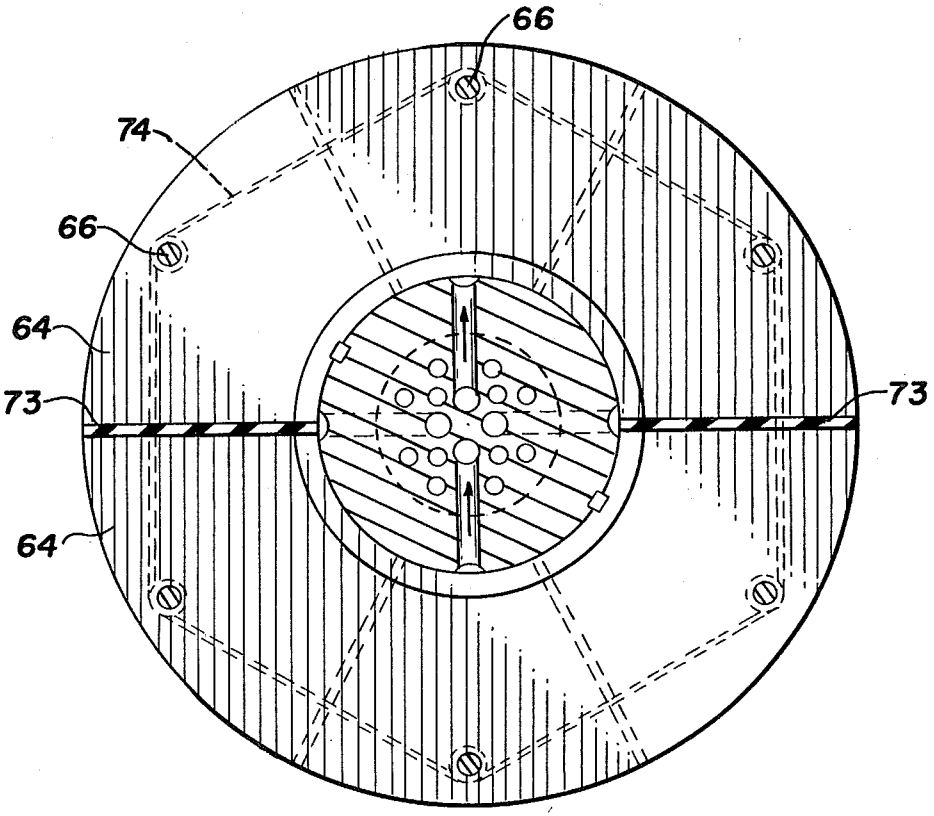
FIG. 9 is a cross-section of FIG. 8 taken on the plane IX—IX.
Figure 8:
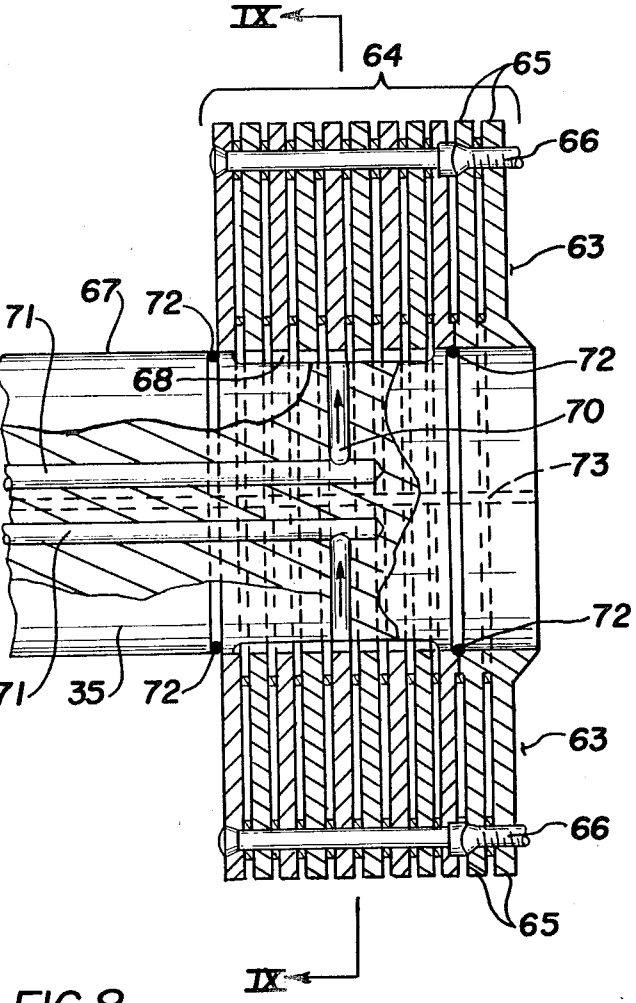
FIG. 8 is a detail of a third embodiment of a roll of my invention.

Rolls of the prior art, FIG. 6B, do not have primary, lateral heat exchange across large areas of thin material. Only secondary and tertiary radial exchanges, over very long time units, are available. L/T approaches $RT/W<1$ where R is roll radius and W is roll width, with no practical effect on roll expansion. It follows that the treating fluid should be introduced into the grooves between the fins at the center of the roll and withdrawn at the roll end. Improved heat transfer to and from the fins can be obtained by utilizing a metal having heat conductivity higher than steel for the fins. In FIG. 7 a steel arbor 35 is formed with a circumferential cavity 63 in its surface below sleeve 36. In that cavity are fixed groups 64 of annular fins 65 as in FIG. 8, of a higher thermal conductivity than steel. Bronze with a thermal conductivity about four times that of steel is commercially available for such purposes .Each fin 65 is spaced from adjacent fins along the axis of the roll as is shown in FIG. 8, but only by an amount adequate to permit circulation of a heat exchange fluid between them. The fins in each group 64 are held together by longitudinal ties 66 which pass through holes in the fins. In the bottom surface 67 of cavity 63 a channel 68 is formed extending longitudinally beneath one or more of the fins of group 64 in cavity 63 and connecting with the spaces between identical fins 65 in those groups. A cross-bore 70 opening from channel 68 connects with longitudinal bore 71 which extends through an end of arbor 35. "O" rings 72 of rubber or like material are fitted between arbor 35 and each end of group 64 so as to seal off each group 64 from adjoining groups. In order to assemble fin groups 64 in cavity 63 they are split in halves on a plane through a diameter as is shown in FIG. 9, and the halves sealed by gasket 73. The planes of splitting of the various groups 64 are angularly offset from each other as is shown in the dash lines in FIG. 9. The split fin groups 64 are held in place on arbor 35 during assembly by wires 74 pulled around tie bolts 66.

Figure 10:
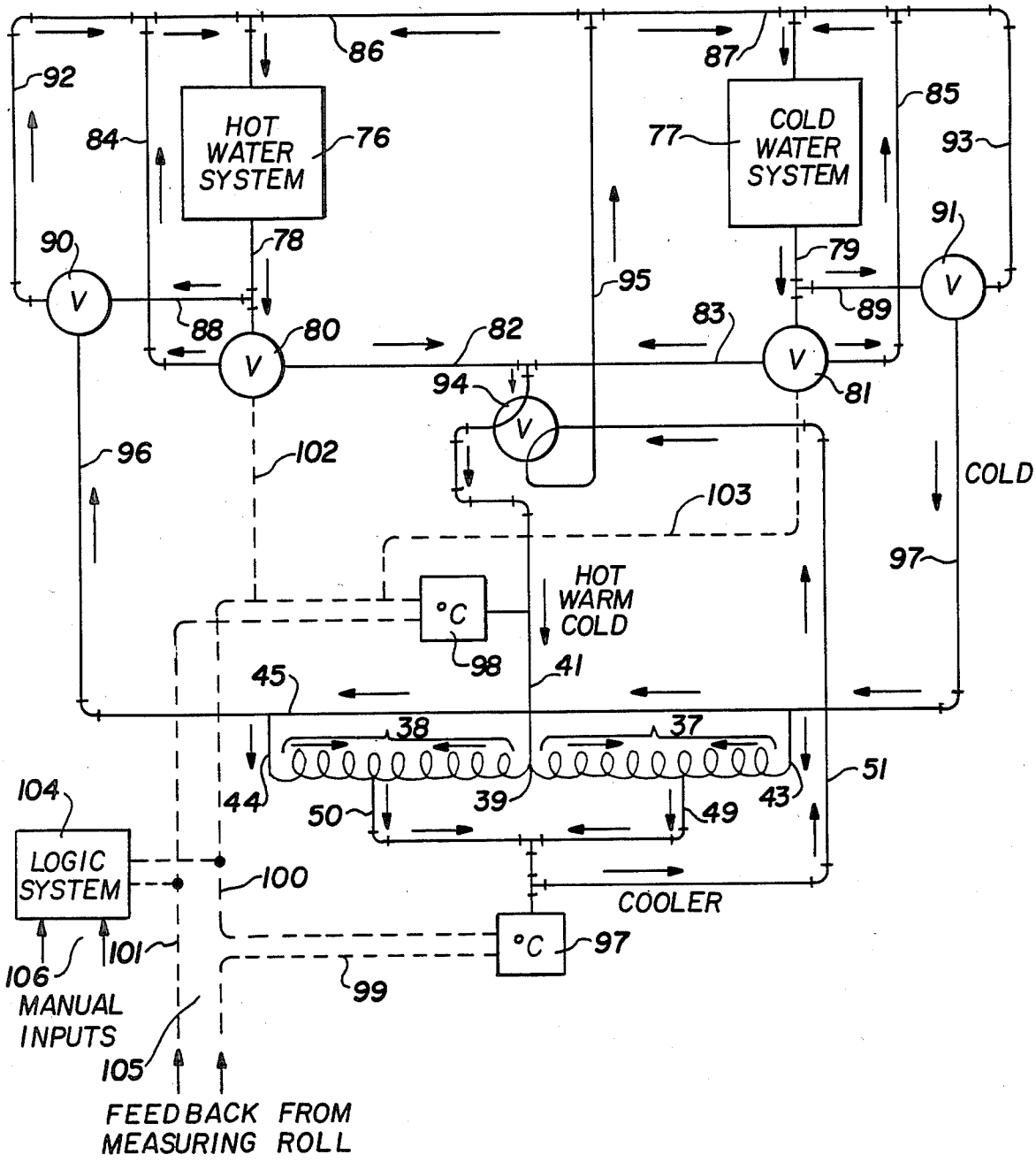
FIG. 10 is a schematic of heat exchange liquid supply apparatus for rolls of my invention in forward flow condition and the direction of liquid flow therein.
Figure 11:
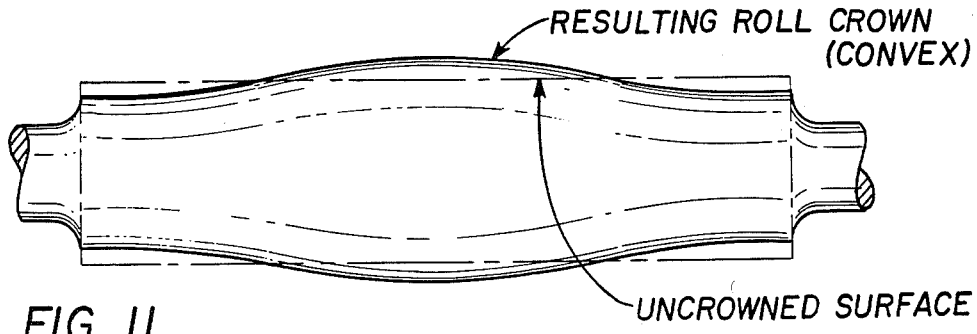
FIG. 11 is a profile of a roll of my invention controlled by the apparatus of FIG. 10 showing in exaggerated form the resulting convex roll crown.
Figure 12:
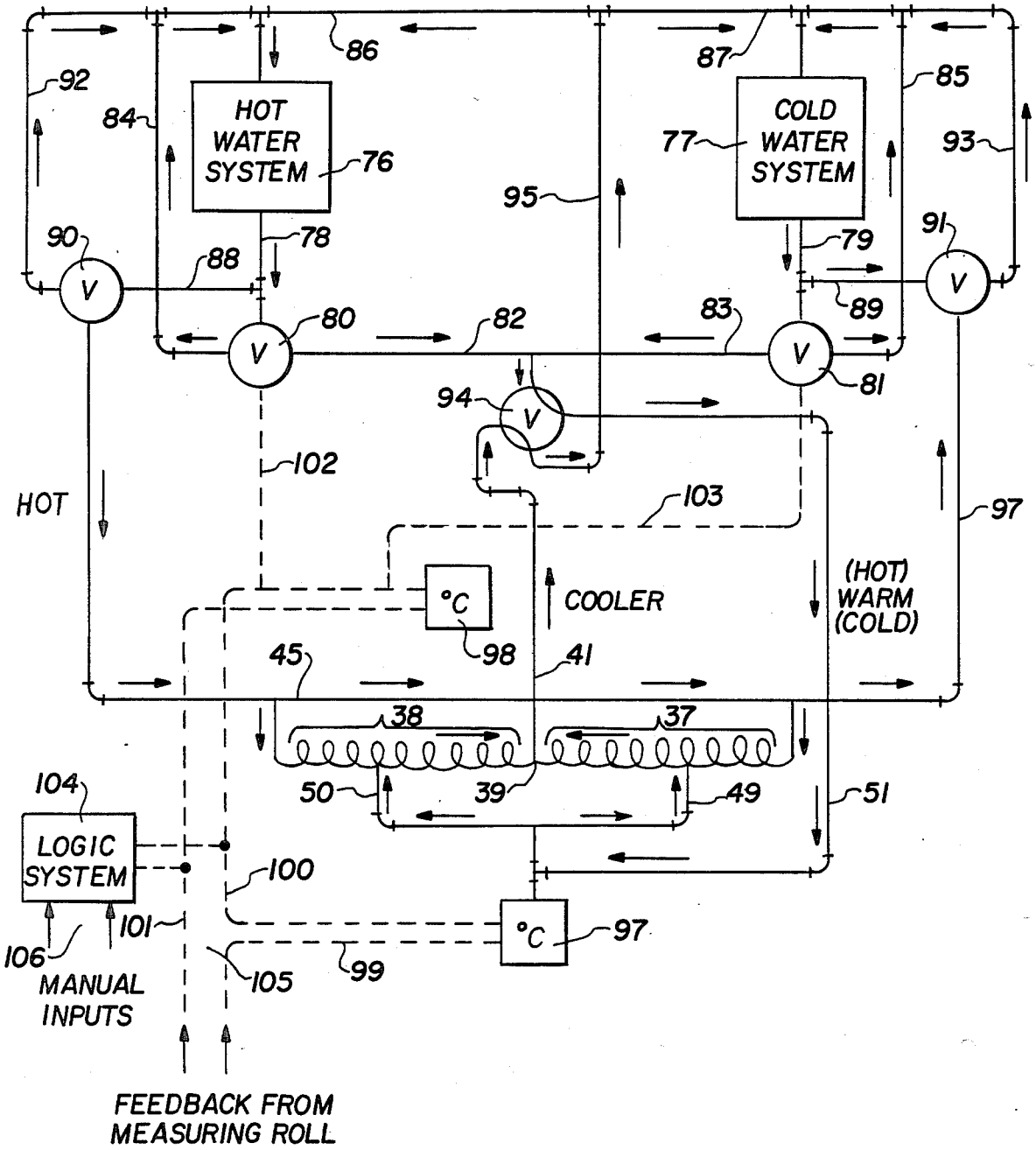
FIG. 12 is a schematic of heat exchange liquid supply apparatus for rolls of my invention in reverse flow condition and the direction of liquid flow therein.
Figure 13:
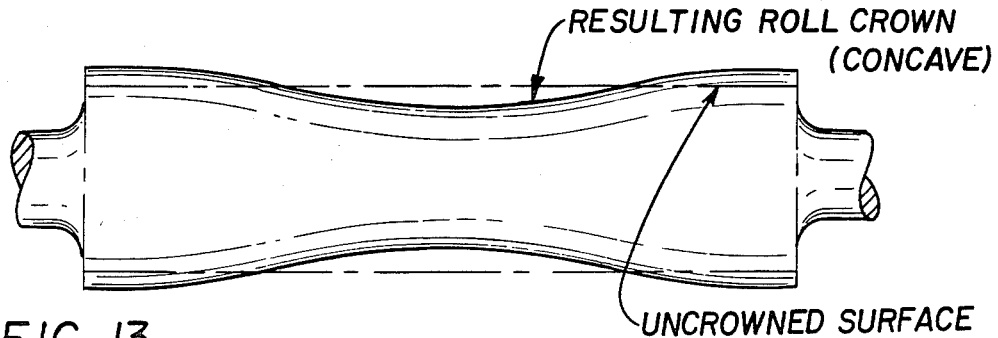
FIG. 13 is a profile of a roll of my invention supplied by the apparatus of FIG. 12 showing in exaggerated form the resulting concave roll crown.

Apparatus for supplying heat exchange fluid to my roll is shown diagrammatically in two conditions in FIGS. 10 and 12 and the resulting roll crowns are shown in exaggerated form in FIGS. 11 and 13 respectively. The roll itself is not shown in FIGS. 10 and 12; merely a representation of the spiral grooves 37 and 38 of FIG. 5 which constitute roll heat exchange zones, and their connecting bores 41, 50 and 51. A hot water or other heat exchange liquid system 76 including a reservoir, pump, heater and valving has a hot water delivery pipe 78 connecting it with a proportioning valve 80 which delivers hot water to line 82, and also to line 88 which returns the hot water to system 76, in proportion determined as will be described hereinafter. A cold water or other heat exchange liquid system 77 including a reservoir, pump, cooling and valving has a delivery pipe 79 connecting it with a proportioning valve 81 which delivers cold water to line 83, and also to line 85 which returns cold water to system 77, in proportion likewise to be described.

Hot water system outlet 78 also connects with pipe 88 which delivers to three-way valve 90. One outlet of valve 90 recirculates hot water through pipe to system 76. The other outlet of valve 90 connects with pipe 96, which in turn connects through bore 45 in the roll and cross-bores 44 and 43 with the outside ends of spiral grooves 38 and 37. Cold water system outlet 79 also connects with pipe 89 which delivers cold water to three-way valve 91. One outlet of valve 91 recirculates cold water through pipe 93 to system 77. The other outlet of valve 91 connects with pipe 97 which connects in turn through bore 45 in the roll and cross-bores 43 and 44 with the outside ends of spiral grooves 37 and 38. The junction 39 of spiral grooves 43 and 44 connects through cross-bore 40 and bore 41 with one port of four-way valve 94. The center grooves of heat exchange zones 37 and 38 respectively connect through cross-bores 49 and 50 to longitudinal bore 51 which is connected with a second port of four-way valve 94. The third port connects with lines 82 and 83 previously mentioned, and the fourth port through a line 95 and lines 86 and 87 connects with hot water system 76 and cold water system 77 respectively.

A temperature sensor 97 is affixed to line 51 and a temperature sensor 98 is affixed to line 41. Temperature sensors 97 and 98 convert the temperature of the water they sense into electrical signals. Sensor 97 is connected by lead 100 to a microprocessor 104 and to sensor 98 and through leads 102 and 103 to proportioning valves 80 and 81 respectively. Microprocessor 104 is connected by lead 101 to temperature sensor 98. A feedback signal 105 from a shape sensor in a roll or other device downstream, not shown, is applied to leads 99 and 101. Manual inputs 106 to microprocessor 104 allow it to be preset to a desired crown. My apparatus described hereinabove will control the temperature along the roll so as to maintain the roll crown at the desired profile. FIG. 11 illustrates the roll crown so obtained.

FIG. 10 illustrates my control apparatus in the forward flow condition, that is, in which hot water is supplied to the adjoining channels of the heat exchange zones 37 and 38 and cold water to the outside ends of each zone. The direction of flow shown by the arrows is controlled by three-way valves 90 and 91 and four-way valve 94. Hot water from lines 78 and 82 passes through four-way valve 94 into line 41 and to the junction of heat exchange zones 37 and 38 in the roll. Cold water from line 89 passes through line 97 and bore 45 to cross-bores 43 and 44 and the outside ends of heat exchange zones 37 and 38. Water at intermediate temperature leaving those zones through cross bores 49 and 50 and pipe 51 passes through four-way valve 94 which directs it through pipe 95 to pipes 86 and 87. Whether the return water goes to the hot water system 76 or the cold water system 77 is governed by proportioning valves 80 and 81 which are adjusted so that when one acts to increase the flow of water circulating back to its system, such as hot water through valve 80 and pipe 84 to hot water system 76, the other acts to decrease the flow of cold water circulating through valve 81 and pipe 85 to the cold water system 77. Under those conditions the bulk of the water returning through pipe 95 goes through pipe 87 to cold water system 77.

The proportioning valves 80 and 81 are automatically controlled in accordance with the temperatures of the water entering the heat exchange zones 37 and 38 and the temperature of the water leaving those zones. The first-mentioned temperature is measured by the temperature sensor 98 and the second by temperature sensor 97. Suitable proportioning valves and temperature sensors are commercially available. The signals from temperature sensors 97 and 98 together with a signal 105 from a roll shape sensor positioned downstream in the mill in question, preferably in a measuring roll, are supplied to microprocessor 104 which sends control signals to proportioning valves 80 and 81. Manual controls 106 in the microprocessor are set to a predetermined crown.

FIG. 12 illustrates the same circuit as FIG. 10 but in its reverse flow condition. The two proportioning valves 80 and 81 and four-way valve 94 are turned to their second or reverse positions as shown. The arrows on the figures show the flow direction in the reverse flow condition. The ends of the mill roll are heated and its center is cooled, bringing about the roll profile of FIG. 13.

While hot and cold water comprise the most convenient hot and cold heat exchange fluids, my invention can be practiced with other liquids or with gases. Superheated water, or steam, for example, could be used for the hot heat exchange medium.

In the following claims the term "center section" includes a single center section of circumferential grooves and sections which adjoin each other on opposite sides of a central plane normal to the roll axis.

In the foregoing specification I have described presently preferred embodiments of my invention; however, it will be understood that my invention can be otherwise embodied within the scope of the following claims.

I claim:

1. In an adjustable crown rolling mill roll for rolling metal comprising a substantially inflexible arbor, a shrunk fit metal sleeve thereon and means for introducing an externally generated heating or cooling heat transfer fluid medium between arbor and sleeve;

the improvement comprising a plurality of parallel circumferential grooves in the surface of said arbor connected together and spaced from each other along siad arbor so as to divide said arbor surface encompassed therebetween into fins having ends contacting said sleeve and having an axial dimension sufficient to transmit rolling pressure from said arbor to said sleeve for pushing said roll sleeve outwardly when said fins are thermally expanded radially outwardly into contact with said sleeve upon heating by said fluid medium and a radially dimension substantially greater than the axial dimension sufficient to effectuate greater heat transfer between fins and said heat transfer fluid medium than between said sleeve and said heat transfer, fluid medium for permitting said roll sleeve to contract inwardly when said fins are thermally contracted radially inwardly upon cooling by said fluid medium.

2. The roll of claim 1 in which the radial dimension of the fins is at least four times the axial dimension of the fins.

3. The roll of claim 2 in which the radial dimension of the fins is not more than about 10 times the axial dimension of the fins.

4. The roll of claim 1 in which said fins are formed of material having a higher heat conductivity than the material of the arbor.

5. The roll of claim 1 in which said parallel circumferential grooves are connected by passages through adjoining

6. The roll of claim 1 in which the plurality of circumferential grooves is divided into at least two sections along the roll and the means for introducing externally generated heat transfer medium includes inlet and outlet conduits in said arbor for each section.

7. The roll of claim 6 in which one of said sections is a center section and the other of said sections is an off-center section.

8. The roll of claim 7 including a conduit in said arbor connecting with the mid point of said center section and a conduit in said arbor connecting with the mid point of said off-center section.

9. The roll of claim 7 including a hot heat exchange liquid source external of said roll, a cold heat exchange liquid source external of said roll and four-way valve means connecting said hot heat exchange liquid source and said cold heat exchange liquid source with said bores, adapted in a first position to conduct hot heat exchange liquid to and from said inlet and outlet conduits respectively of said center section and cold heat exchange liquid to and from said inlet and outlet conduits respectively of said off-center section and in a second position to conduct hot heat exchange liquid to and from said inlet and outlet conduits respectively of said off-center section and conduct cold heat exchange liquid to and from of said inlet and outlet conduits respectively of said center section.

10. The rolling mill of claim 9 including a first three-way valve with its input port and one outpout port connected with said hot heat exchange liquid means, a second three-way valve with its input port and one output port connected with said cold heat exchange liquid source and means connecting the remaining output ports of both said three-way valves with said liquid conduit at the end of said working surfaces.

11. The rolling mill of claim 9 including a first proportioning valve with its input port and one output port connected with said hot heat exchange liquid source, a second proportioning valve with its input port and one output port connected with said cold heat exchange liquid source and means connecting the other output ports of both said proportioning valves with said four-way valve means whereby adjustment of said proportioning valves adjusts the volumes of said hot heat exchange liquid and said cold heat exchange liquid entering said liquid conduits

12. The rolling mill of claim 11 including first temperature measuring means positioned externally to said rolls adapted to measure the temperature of heat exchange liquid at the center of said working surface, second temperature measuring means positioned external to said rolls adapted to measure the temperature of heat exchange liquid at said positions intermediate said center and said ends of said working surface and means for adjusting said proportioning valves in accordance with the differences between said temperatures.

* * * * *

UNITED STATES PATENT AND TRADEMARK OFFICE

CERTIFICATE OF CORRECTION

PATENT NO. : 4,793,172

DATED : December 27, 1988

INVENTOR(S) : Werner W. Eibe

It is certified that error appears in the above-identified patent and that said Letters Patent is hereby corrected as shown below:

Column 1 Line 52 "pair" should read --paired--.

Column 5 Line 45 delete "holes in" and insert --grooves 37 between--.

Column 5 Line 55 "argest" should read --largest--.

Column 6 Line 8 "ara" should read --area--.

Column 6 Line 11 "throuogh" should read --through--.

Column 6 Line 13 "35" should read --36--.

Column 6 Line 36 "RT/W" should read --R/W--.

Column 6 Line 48 "purposes .Each" should read --purposes. Each--.

Column 7 Line 24 after "delivers" insert --water--.

UNITED STATES PATENT AND TRADEMARK OFFICE

CERTIFICATE OF CORRECTION

PATENT NO. : 4,793,172

DATED : December 27, 1988

INVENTOR(S) : Werner W. Eibe

It is certified that error appears in the above-identified patent and that said Letters Patent is hereby corrected as shown below:

Column 7 Line 25 after "pipe" insert --92--.

Claim 1 Column 8 Line 62 "siad" should read --said--.

Claim 1 Column 9 Line 1 "radially" should read --radial--.

Claim 5 Column 9 Lines 20-21 after "adjoining" insert --fins.--.

Claim 10 Column 10 Line 11 "outpout" should read --output--.

Claim 11 Column 10 Line 28 after "conduits" insert --.--.

Signed and Sealed this

Eighth Day of August, 1989

*Attest:*

DONALD J. QUIGG

*Attesting Officer*

*Commissioner of Patents and Trademarks*